US005862652A

United States Patent [19]

Schoeler

[11] Patent Number: 5,862,652

[45] Date of Patent: Jan. 26, 1999

[54] TUBULAR BAGGING MACHINE WITH AN ASYMMETRICAL FORMING SHOULDER AND TUBULAR BAGS WITH AN EDGE-SIDE LONGITUDINAL SEAM

[75] Inventor: Wolfgang Schoeler, Lawrenceville, Ga.

[73] Assignee: Rovema Packaging Machines, L.P., Lawrenceville, Ga.

[21] Appl. No.: 888,955

[22] Filed: Jul. 7, 1997

Related U.S. Application Data

[62] Division of Ser. No. 609,298, Mar. 1, 1996, abandoned.

[30] Foreign Application Priority Data

| | | | |
|---|---|---|---|
| Mar. 3, 1995 | [DE] | Germany | 195 07 444.0 |
| Mar. 3, 1995 | [DE] | Germany | 195 07 445.9 |
| Jan. 31, 1996 | [DE] | Germany | 196 03 371.3 |

[51] Int. Cl.[6] ..... B65B 9/20; B65B 9/22; B65B 51/26

[52] U.S. Cl. ..... 53/551; 53/552; 53/371.3; 53/371.4; 493/302; 493/308

[58] Field of Search ..... 53/451, 551, 370.5, 53/371.3, 371.4, 552; 383/107, 105, 120, 125; 493/302, 308

[56] References Cited

U.S. PATENT DOCUMENTS

| | | | |
|---|---|---|---|
| 2,370,226 | 2/1945 | Brede et al. | 383/107 X |
| 3,006,257 | 10/1961 | Orsini | 383/120 X |
| 3,023,947 | 3/1962 | McDuffie | 383/107 X |
| 3,314,591 | 4/1967 | Cheeley | 383/107 X |
| 3,426,499 | 2/1969 | Paige | 53/451 |
| 3,543,467 | 12/1970 | Leasure | 53/451 |
| 3,599,387 | 8/1971 | James | 53/551 X |
| 3,681,892 | 8/1972 | Safranski | 53/551 |
| 3,785,112 | 1/1974 | Leasure et al. | 53/551 X |
| 3,851,814 | 12/1974 | Stage | 383/107 X |
| 4,074,504 | 2/1978 | Greenawalt et al. | 53/451 X |
| 4,077,186 | 3/1978 | Voegele | 53/451 |
| 4,127,976 | 12/1978 | Jablonski et al. | 53/551 X |
| 4,194,438 | 3/1980 | Schmachtel . | |
| 4,337,862 | 7/1982 | Suter | 53/451 X |
| 4,468,812 | 8/1984 | Grosvenor | 383/107 X |
| 4,597,103 | 6/1986 | Hoover | 383/120 |
| 4,604,854 | 8/1986 | Andreas | 53/552 |
| 4,913,561 | 4/1990 | Beer | 383/120 X |
| 4,943,167 | 7/1990 | Gelbard | 383/107 X |
| 4,986,054 | 1/1991 | McMahon | 53/552 X |
| 5,014,497 | 5/1991 | McMahon | 53/551 X |
| 5,046,300 | 9/1991 | Custer et al. | 53/451 X |
| 5,149,201 | 9/1992 | Benoit | 383/120 X |
| 5,547,284 | 8/1996 | Imer | 383/105 X |

*Primary Examiner*—Horace M. Culver
*Attorney, Agent, or Firm*—Flynn, Thiel, Boutell & Tanis, P.C.

[57] ABSTRACT

To avoid the folding of a flat tubular bag 1, which has been set up supported on its bottom-side cross seam 4, a welding seam 7, 8 reinforcing the tubular bag 1 is provided along at least one edge 5, 6. A further tubular bag 101 is introduced, where on the side folds 110, 111 of which the edges 105, 106 have welding seams 107, 108. Because of the welding seams 107, 108, the stability of the tubular bag 101 is improved. The longitudinal seam 2, 102 in the two tubular bags 1, 101 extends in a reinforcing welding seam 7, 107. The tubular bagging machine 14 for the manufacture of the tubular bag 1, 101 has at least one expanding element on the fill pipe 20 for expanding the film tube 21. A longitudinal welding device 22 is provided following the expanding element 27 in film feeding direction (FIGS. 7, 8).

22 Claims, 9 Drawing Sheets

TUBULAR BAGGING MACHINE WITH AN ASYMMETRICAL FORMING SHOULDER AND TUBULAR BAGS WITH AN EDGE-SIDE LONGITUDINAL SEAM

This is a division of Ser. No. 08/609,298, filed Mar. 1, 1996, now abandoned.

FIELD OF THE INVENTION

The invention relates on the one hand to a tubular bag with a side fold, a longitudinal seam and cross seams extending perpendicularly with respect to the longitudinal seam and parallel to one another for closing off the tubular bag at the top, and, on the other hand, to a tubular bagging machine for the manufacture of tubular bags.

BACKGROUND OF THE INVENTION

Flat tubular bags of the described type are known. The bag surfaces of such bags, which lie congruent on one another, are simply folded at the edges extending parallel to the longitudinal seam, thus achieving the flat bag shape. Side-fold bags are also known.

Also tubular bagging machines for the manufacture of such bags are known.

The known flat, filled tubular bags of the described type have the disadvantage that they are not suited to stand erect for presentation in a tray since they have the tendency to fold and fall over. The folding occurs mainly parallel to the cross seams of the bags standing on their bottom-side cross seam, and is particularly prevalent when a row to be filled with bags arranged one behind the other in a tray is not complete so that the row to be filled is not supported by a boundary of the tray.

Tubular bagging machines with a side-fold producer are known, in which a side fold in a film tube is produced by a movable side-fold bar. Also side-fold bars movable toward one another are known, which create two oppositely lying side folds in the film tube. Such tubular bagging machines create tubular bags with a side fold or with two side folds. The tubular bags are welded together at the top and at the bottom by cross seams. The side folds are merely welded into the cross seams.

The disadvantage of the known tubular bagging machines with a side-fold bar or with two side-fold bars is that the created tubular bags while having greater relatively stability against deformations because of the side folds, however, still lack a greater stability required for many areas of use.

A tubular bagging machine with an asymmetrical forming shoulder is known from the U.S. Pat. No. 4,194,438. The forming shoulder is used to shift the longitudinal seam of a tubular bag with a rectangular cross section to the edge of the tubular bag in order to avoid a longitudinal seam extending centrally on a side surface of the tubular bag, and in order to be able to utilize, in this manner, the surface of the side surface efficiently for product information.

U.S. Pat. No. 3,426,499 also discloses an arrangement for shifting the longitudinal seam into a corner of a square-shaped bag.

The devices of the U.S. Pat. No. 4,194,438 and of U.S. Pat. No. 3,426,499 have the disadvantage that their longitudinal seams hardly prevent a folding of the corners of the tubular bag.

SUMMARY OF THE INVENTION

The basic purpose of the invention is to devise a flat tubular bag and a tubular bag with side folds of the abovedescribed type and a tubular bagging machine for the manufacture of a tubular bag, such that the tubular bags fold infrequently or rather no longer stand at all in the erect less supported known arrangement on the bottom-side cross seam, and that the longitudinal seam does not interfere with the printed image on the side surfaces. The tubular bags are supposed to be stabilized without additional parts and are supposed to be manufacturable with high machine efficiency with a tubular bagging machine.

The tubular bagging machine of the invention has a flat expanding element on its fill pipe, which expanding element is aligned parallel with respect to the jaws of the cross welding device, points radially away from said fill pipe, and which expanding element lies in one plane with the sealing surfaces of the closed jaws, and a longitudinal welding device arranged after the expanding element in the film feeding direction.

The tubular bagging machine of the invention has the advantage that the tubular bags can be manufactured with a relatively high machine performance with high precision. The longitudinal welding device heats up and presses the area of the welding seam. The arrangement of the expanding element in one plane with the sealing surfaces of the closed jaws serves to control the course of the film tube and to exactly align the edge-side arrangement of the welding seam. The asymmetrical forming shoulder aligns the edge-side arrangement and thus manufacturing an undisturbed side surface serving as an information-providing surface.

A welding seam designed as a longitudinal seam is according to a further embodiment provided on a flat tubular bag of the described type on an edge of the tubular bag.

The flat tubular bag of the invention has the advantage that it has, in the filled state, a clearly reduced folding tendency about a fold line extending parallel to the cross seams, since the edge-side welding seam extending parallel with respect to the longitudinal seam improves the stiffness of the bag. In addition, with the edge-side welding of the cover surfaces lying on one another, a sheering of the cover surfaces is essentially prevented so that the tubular bag can be set up erect on a bottom-side cross seam in a tray, and even in an incompletely filled row, the tubular bag clearly exhibits reduced folding behavior. The edge-side longitudinal seam enables an improved use of the side surfaces of the tubular bag, for example, by means of continuous lettering not disturbed by the longitudinal seam.

The tubular bag according to another embodiment has a longitudinal seam, parallel cross seams extending perpendicularly to the longitudinal seam for closing off the tubular bag at the top and bottom, and a side fold. The welding seam is provided on the two edges of the side fold, which edges extend parallel with respect to the longitudinal seam. The longitudinal seam extends on the edge side.

The tubular bag with the side fold is stronger in withstanding deformations because of its edge-side welding seam compared with a simple tubular bag with a side fold. In order to manufacture the tubular bag, a separate supply of reinforcing material is not necessary, since merely the film tube is supplied at any specified rate and is welded to itself. The created tubular bags can be relatively quickly loaded by filling them since, for example, the still warm welding seams at the edges cannot be pulled open by pulling forces acting parallel with respect to the welding seams, and since the welding seams do not need to meet the requirements regarding a sealing capability. The edge-side longitudinal seam improves the use of the side surfaces of the tubular bag as an information providing surface.

When the longitudinal welding device includes a radiating heater and a closing device, then it is achieved that the heat introduction into the packaging film is done without applying a force. This is advantageous since the still open longitudinal area of the film tube does not experience any influence on its shape nor holding-back forces through its heat absorption. The heated longitudinal seam is then pressed together by applying pressure. This pressure application can be accomplished by means of a roller, which itself can be driven synchronously with respect to the film transport. When the wheel is driven, then the forces acting on the longitudinal seam are minimized. Instead of a wheel it is, however, also possible to use a relatively simple closing device, as, for example, a pressing beam.

Two expanding elements can be provided on the tubular bagging machine of the invention, which expanding elements point away in opposite directions from the fill pipe, whereby after each expanding element follows in the film feeding direction a radiating heater and a closing device. Tubular bags with two edge-side welding seams are produced with such a design of the tubular bagging machine. Utilizing two expanding elements arranged symmetrically with respect to the center axis of the fill pipe, also results in the deforming forces and the frictional forces being the same on both sides of the fill pipe on the expanding elements during the creation of the edge-side welding seams, and that thus the course of the film is not disturbed.

When the radiating heater is arranged at an acute angle with respect to the surface of the fill pipe, and the inside distance between the radiating heater and the fill pipe is reduced in film feeding direction, the plastic melts more carefully and the possibility exists to alter the welding parameters through a change in the angle.

As the radiating heater, it is possible to use a longitudinal sealing jaw aligned in film feeding direction or an infrared radiating coil. The efficiency of an infrared radiating coil can be clearly increased, and an exact radiation zone can be achieved when, according to a further embodiment, the infrared radiating coil is surrounded on three sides by an arched mirror reflecting onto the film tube.

When the closing device is a pair of oppositely directed rollers clamping the welding seam between their outer surfaces, then the welding of a melted longitudinal seam can be done solely by the pressure of the rollers. The rollers can be stationarily arranged independent of the type of operation of the tubular bagging machine. The rollers can, in addition, be designed with or without a drive means. If a drive means is provided, the rollers are to be driven with a speed corresponding to the unwinding speed of the film feeding means.

A bothersome adhering of melted plastic of the film on the outer surfaces of the rollers does not happen when the outer surfaces, according to a further amendment have a coating of polytetrafluoroethylene.

When the longitudinal welding device is a heat-sealing band rotating around two rollers, then there exists a further possibility to carry out a distortion-free welding of an edge-side longitudinal seam. The heat-sealing band is driven at the same speed as the film tube moving on the tubular bagging machine and welds the same with precision, since it also stabilizes and stationarily precisely positions the open longitudinal slot of the film tube.

A compact design of the aggregates on the fill pipe is possible, and a reliable film feed is achieved when the film feeding means has two oppositely directed rotating unwinding belts offset at 90 degrees with respect to the expanding element or the expanding elements on the fill pipe. The unwinding belts and the expanding elements can thereby be arranged in one plane, which causes the unwinding belts and expanding elements to achieve their most compact design. In addition, distorting forces acting on the film tube are hereby relatively well compensated for.

Flat tubular bags with a completely welded side fold can be produced when the expanding element is designed as a double-expanding element with a side-fold producer engaging between the individual expanding elements of the double-expanding element. The individual expanding elements can be expanding plates extending parallel to one another and fastened to the fill pipe, into which engages a side-fold producer aligned toward the fill pipe and designed as a folding wire.

When a cooling plate is inserted into a side fold of the film tube, against which plate the welding device acts, then both edge-side welding seams of the side fold can be welded against the cooling plate. The cooling plate serves thereby merely for the prevention of a four layer welding. The welding device acts on both sides against the cooling plate. With this structure a welding pressure can be applied. An edge-side welding seam is produced on each side of the cooling plate. The film can slide along the cooling plate. An adhering of melted film plastic on the cooling plate can be prevented when, according to a further amendment, the cooling plate has an outer layer containing polytetrafluoroethylene. The cooling plate can also be the side-fold producer, thus making a separate side-fold producer unnecessary. However, if in spite of this, a side-fold producer preceding the double-expanding element in film feeding direction can be provided for further stabilizing the course of the film.

When the initial format of the fill pipe is tapered to a reduced-sized format in a film feeding direction by a tapering format adjusted to cooperate with the forming shoulder, whereby the double-expanding element or the double-expanding elements is or are connected to the section of the fill pipe having the reduced size, and whereby the different fill-pipe radii correspond approximately to two thirds of the radial expansion of the double-expanding element, or, rather, to 1.5 times the radial expansion of one of the two double-expanding elements, the film tube is then moved along the fill pipe and is relatively farther away from the fill pipe. The film tube is, in reference to the fill pipe, transported from the larger initial format to the smaller tapered format of the fill pipe. The double-expanding element or the double-expanding elements is or are provided on the smaller sized format and extend approximately as far radially outwardly so that they compensate the format of fill pipe size differences.

When the film feeding means is continuously driven, the heat radiation can then occur using a permanently stationary radiating heater with a constant radiation performance preventing changes in the melting action of the film. Unwinding speed, heating stretch, radiation performance and cooling-off behavior of the film can be, hereby, particularly well adjusted with respect to one another. Similar welding conditions exist thereby mainly when the radiation performance of the radiating heater is proportional to the speed of the film feeding means.

When the initial format of the fill pipe is tapered to a format reduced in size in film feeding direction by a tapering format adjusted to the forming shoulder, whereby the expanding element or the expanding elements is or are connected to the part of the fill pipe having the reduced-sized format, and whereby the difference of the fill-pipe radii of the different formats corresponds approximately to half of the radial expansion of the two expanding elements, then the film tube travels along the fill pipe in an approximately constant expansion state.

Along the extent of the fill pipe, the film tube is moved from the larger format to the smaller format. The expanding element or the expanding elements is or are provided on the smaller format and extend approximately so far radially outwardly that they balance the format difference.

The stiffness of the flat tubular bag is further increased when the welding seams are provided on both edges, which extend parallel with respect to the longitudinal seam.

The stiffness of an edge-side welding seam is clearly increased in a further embodiment. According to this embodiment, a side fold is provided in an edge-side welding seam, whereby the width of the side fold corresponds at least to half of the width of the welding seam. The welding together of four film areas lying on top of one another occurs hereby. The welding seam is therefore relatively thick and stiff. When the width of the side fold is too narrow, namely clearly less than half of the width of a welding, it can happen that the side fold cannot be reliably fixedly welded. The edge-side welding seam can be designed with a relatively small width since it does not fulfill a sealing function.

The edge-side welding seam can also be further reinforced when an additional film strip is welded along with the welding seam. The film strip can be placed onto the outer film surface or, in the case of a fixedly welded side fold, be inserted into the side fold.

The stiffness of the tubular bag is further increased when on both side folds extending parallel with respect to the longitudinal seam, the two edges of a side fold are each provided with a welding seam.

When the longitudinal seam extends in an edge-side welding seam, then the advantage results that merely one welding operation is sufficient in order to produce both the longitudinal seam and also the edge-side welding seam for reinforcing the bag.

The stability of the tubular bag is further increased and its ability to stand by itself is achieved when the tubular bag is designed as a stand alone or self-supporting bag with a sturdy base.

BRIEF DESCRIPTION OF THE DRAWINGS

The tubular bags and the tubular bagging machine of the invention will be described in greater detail hereinafter in connection with the figures illustrating exemplary embodiments.

In the drawings.

DETAILED DESCRIPTION

Figure 1:
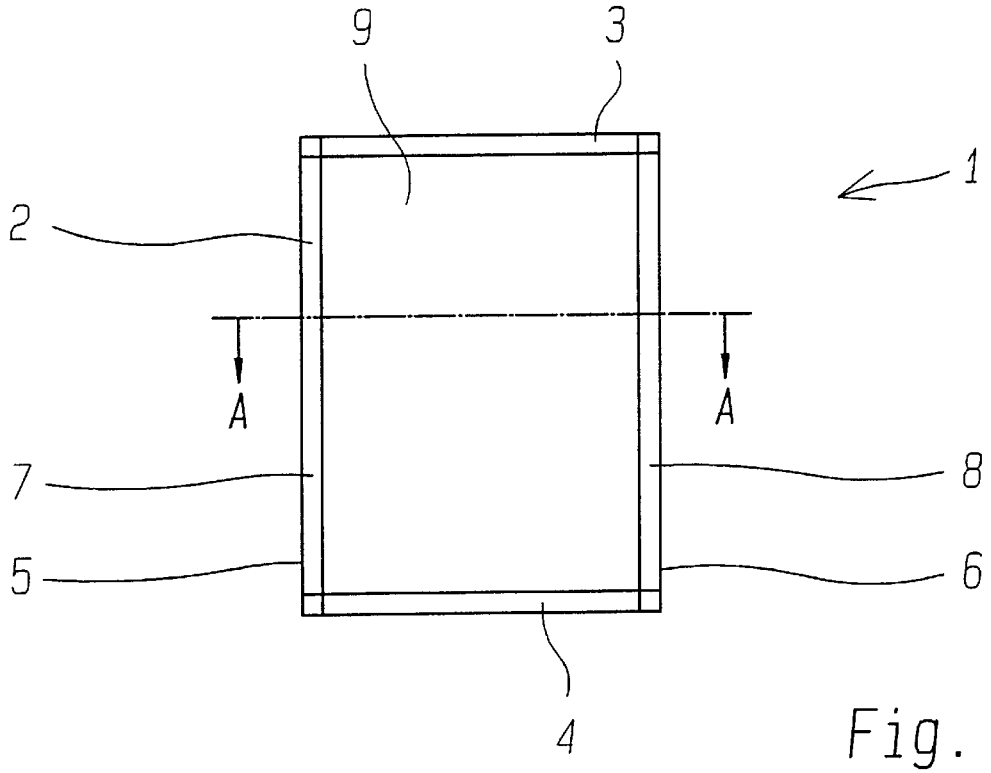
FIG. 1 is a side view of a flat tubular bag with welding seams extending on both edges of the tubular bag, which edges extend parallel to the centrally arranged longitudinal seam.
Figure 2:
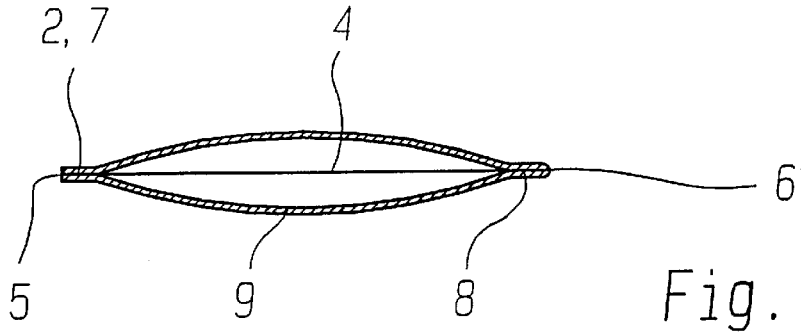
FIG. 2 is a cross-sectional view along the line II—II of the flat tubular bag of FIG. 1.

A flat tubular bag 1 has an edge-side longitudinal seam 2 and cross seams 3, 4 extending perpendicularly with respect to the longitudinal seam 2 and parallel to one another to close off the tubular bag 1 at the top and bottom (FIG. 1, FIG. 2). Welding seams 7, 8 are provided at the edges 5, 6 of the tubular bag 1, which edges extend parallel to the longitudinal seam 2. The welding seams lend a tubular bag 1 set up on the bottom-side cross seam 4 an additional stiffness against folding. The longitudinal seam 2 extends along the edge 5 of the tubular bag 1. The inner surfaces of the film 9 are welded together at the welding seams 7, 8 and the cross seams 3, 4.

Figure 3:
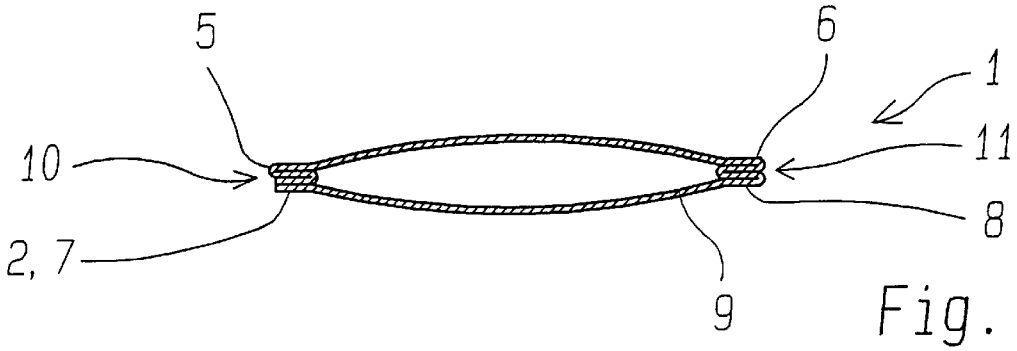
FIG. 3 is a cross-sectional view analogous to FIG. 2 of a flat tubular bag with a longitudinal seam extending in the edge-side welding seam and with a side fold in each edge-side welding seam.
Figure 4:
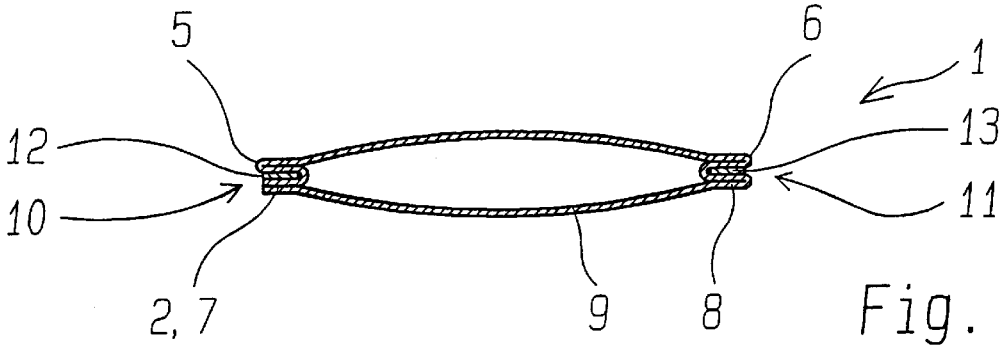
FIG. 4 is a cross-sectional view analogous to FIG. 2 of the flat tubular bag of FIG. 3, however, with an additional film strip in the edge-side welding seams.

Side folds 10, 11 are provided, in a further exemplary embodiment, on the two edge-side welding seams 7, 8 (FIG. 3). The width of one side fold 10, 11 corresponds approximately with the width of one welding seam 7, 8. For the purpose of an additional reinforcement, it is possible to weld into the side folds 10, 11 additional film strips 12, 13 of a weldable plastic (FIG. 4).

The tubular bagging machine 14 (FIG. 9, FIG. 10) for the manufacture of flat tubular bags 1 has a storage roller 15 and guide rollers (schematized by a guide roller 16) for feeding of a flat film band 17 to an asymmetrical forming shoulder 18. A film feeding means 19 transports the film band 17. A fill pipe 20 receives the film band 17, which has been formed into a film tube 21. The flat tubular bag 1 is filled through the fill pipe 20.

Figure 14:
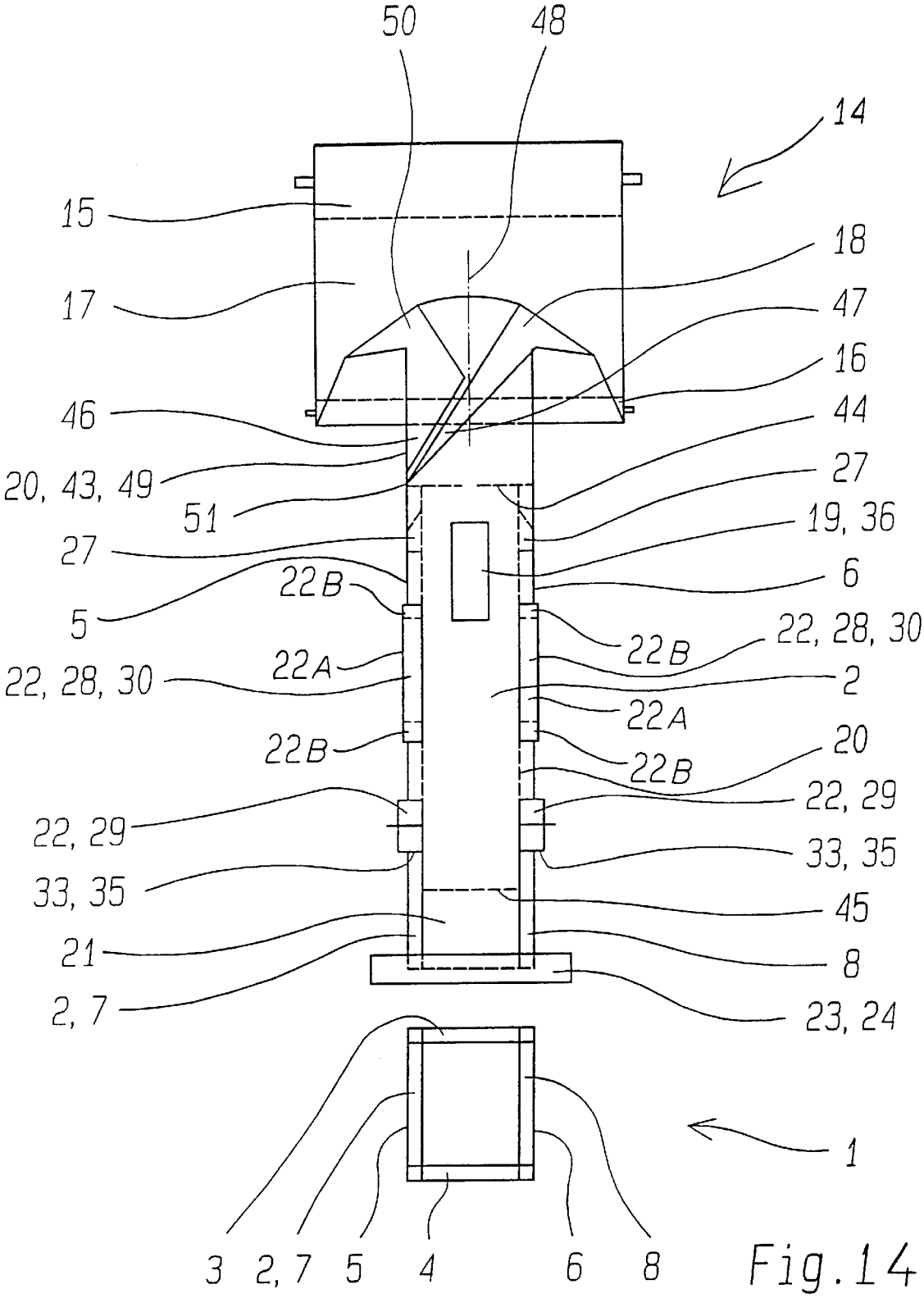
FIG. 14 is a view similar to FIG. 9, but showing the heat sealing band rotating on two rollers.

The longitudinal seam 2 of the film tube 21 is formed by means of a longitudinal welding device 22 having a radiating heater 28 and a closing device 29. The longitudinal welding device 22 may be heat sealing bands 22A each rotating around two rollers 22B (FIG. 14). The cross seams 3, 4 of the flat tubular bag 1 are produced by rotating jaws 23 of a cross-welding device 24 and are separated from the film tube 21 by cutting knives 25 operating as a separating device.

Flat expanding elements 27, which are connected to the fill pipe 20 and point radially away from said round fill pipe 20, are aligned parallel with respect to the sealing surfaces 26 of the jaws 23 and in one plane with the sealing surfaces 26 of the closed jaws 23. The expanding elements 27 deflect the edges 5, 6 of the film tube 21 outwardly. Radiating heaters 28 act onto these edges 5, 6 in order to melt the edges 5, 6. Each radiating heater 28 is followed in film feeding direction by a closing device 29 for pressing the melted edges 5, 6 together.

Figure 11:
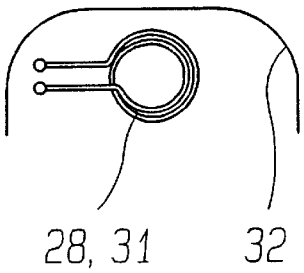
FIG. 11 is a cross-sectional view of a radiating heater designed with a mirror as an infrared radiation coil.
Figure 12:
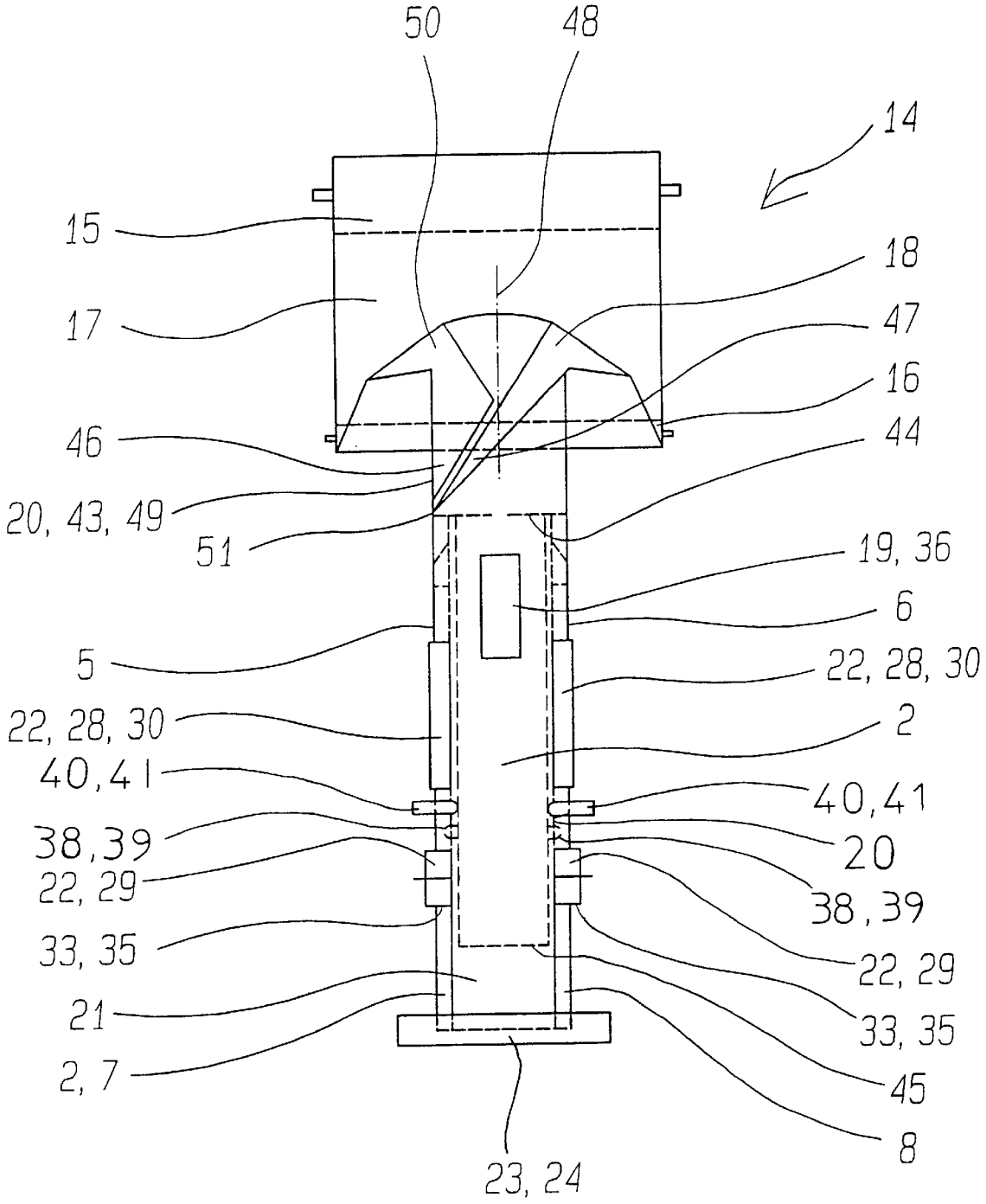
FIG. 12 is a view similar to FIG. 9 and includes the side fold producers preceding the double-expanding elements.
Figure 13:
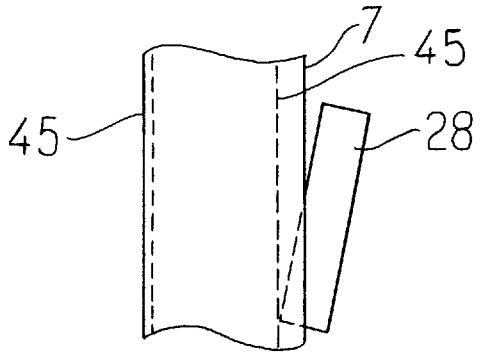
FIG. 13 is a partial side view of FIG. 10, but showing the radiating heater at an acute angle.

The radiating heaters 28 are designed as longitudinal sealing jaws 30 and are aligned in the film feeding direction. They are arranged parallel with respect to the surface of the fill pipe 20. Instead of a longitudinal sealing jaw 30, it is also possible to use as radiating heaters 28 a straight infrared radiating coil 31 aligned in film feeding direction (FIG. 11). The infrared radiating coil 31 can be surrounded for the purpose of a better direction of radiation on three sides by an arched mirror 32 reflecting onto the film tube 21. The radiating heater 28 may be arranged at an acute angle relative to the fill pipe 45 whereby the distance between the radiating heater 28 and the fill pipe 45 is reduced in the fill feeding direction (FIG. 13).

Two pairs of oppositely rotating rollers 34 clamp the welding seams 7, 8 between their outer surfaces 33, thereby functioning as a closing device 29. The rollers 34 are driven with at a speed corresponding to the unwinding speed of the film tube 21 of the film feeding means 19. The outer surfaces 33 of the rollers 34 have a layer 35 containing polytetrafluoroethylene in order to prevent an adhering of the melted film plastic to said outer surfaces 33.

The film feeding means 19 has two unwinding belts 36 rotating in opposite directions, which belts are offset on the fill pipe at 90 degrees with respect to the expanding elements 27.

Figure 5:
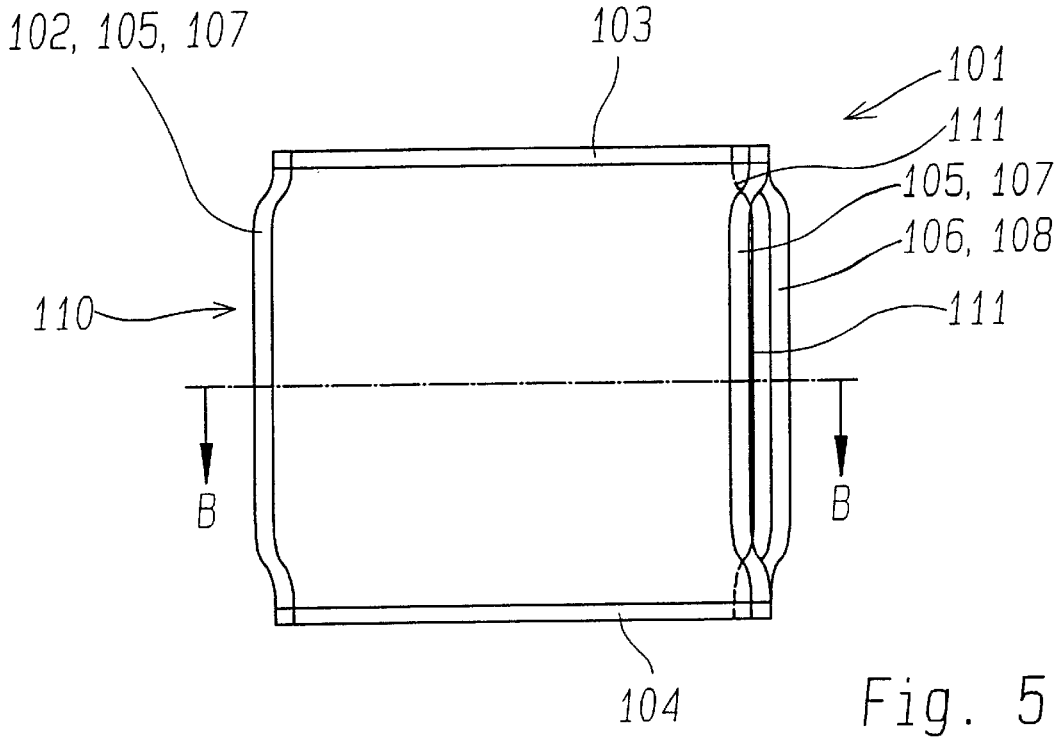
FIG. 5 is an isometric illustration of a tubular bag with two side folds and welding seams extending on each of the two edges of the two longitudinal seams.
Figure 7:
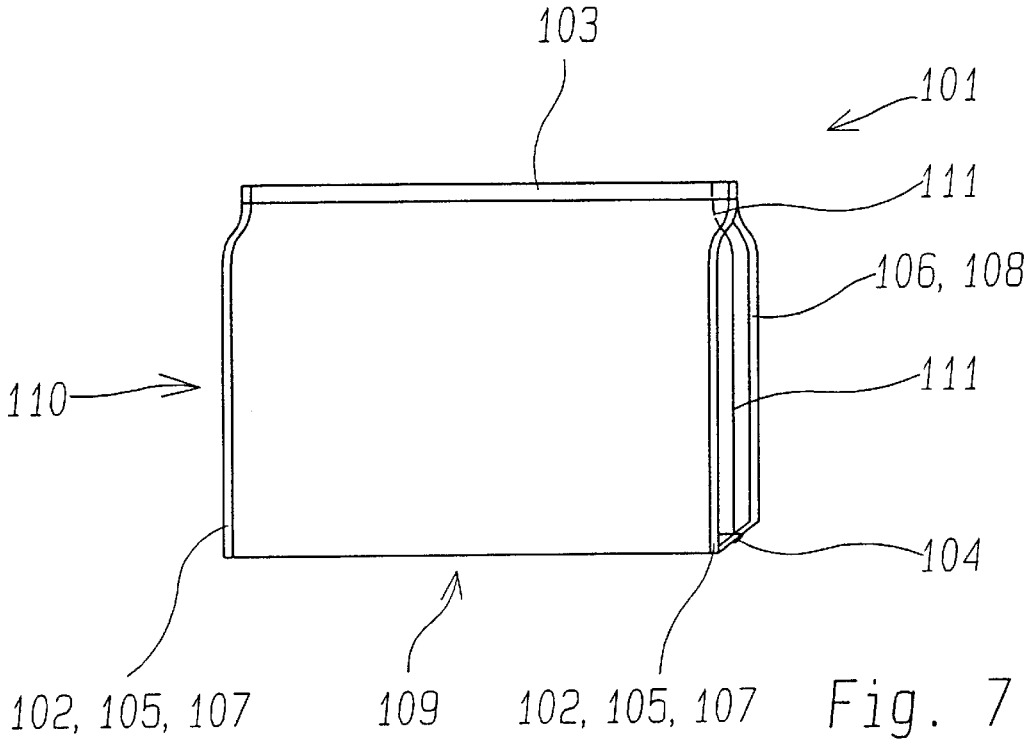
FIG. 7 is an isometric illustration of a stable tubular bag with side folds and edge-side welding seams.
Figure 8:
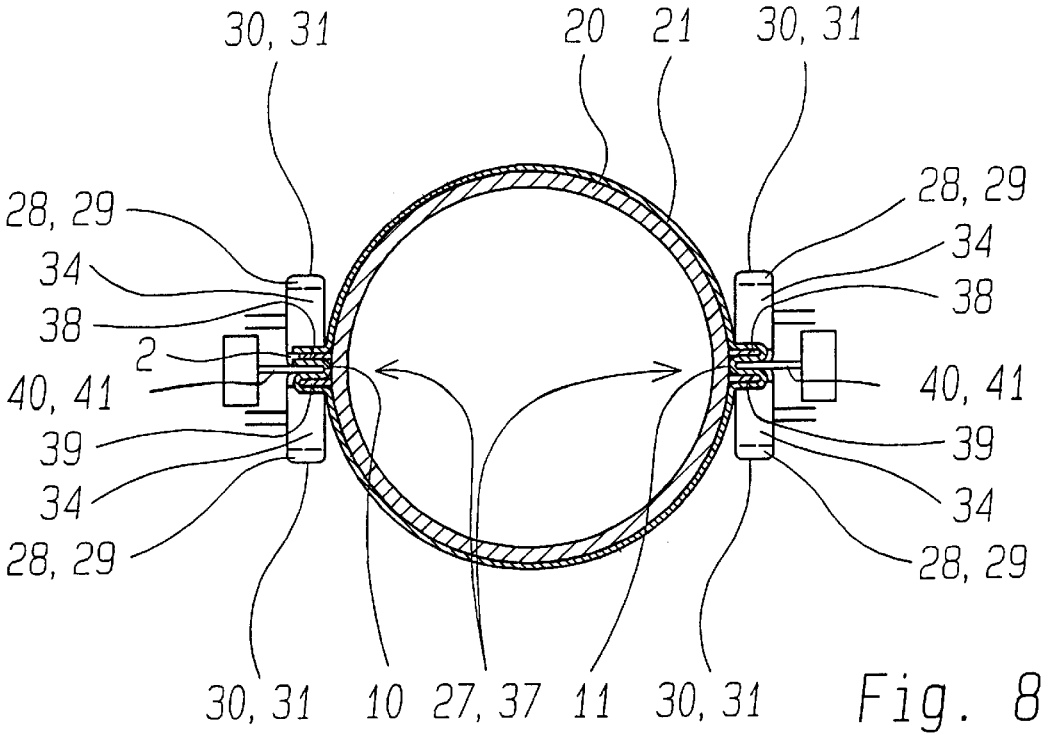
FIG. 8 is a horizontal cross-sectional view of a vertical tubular bagging machine having a fill pipe, a film tube, two double-expanding elements, and a side-fold producer engaging a double-expanding element for the manufacture of a tubular bag corresponding to FIG. 5 or 7.

The expanding elements 27 can also be designed, in order to produce a flat tubular bag analogous to FIG. 3, as double-expanding elements 37 (FIG. 8) with each having one side-fold producer 41 engaging between the individual expanding elements 38, 39 of double-expanding element 37, respectively, and designed as a folding wire 40. Tubular bags analogous to FIGS. 5 and 7 are produced by means of adding additional individual expanding elements 38, 39.

Figure 10:
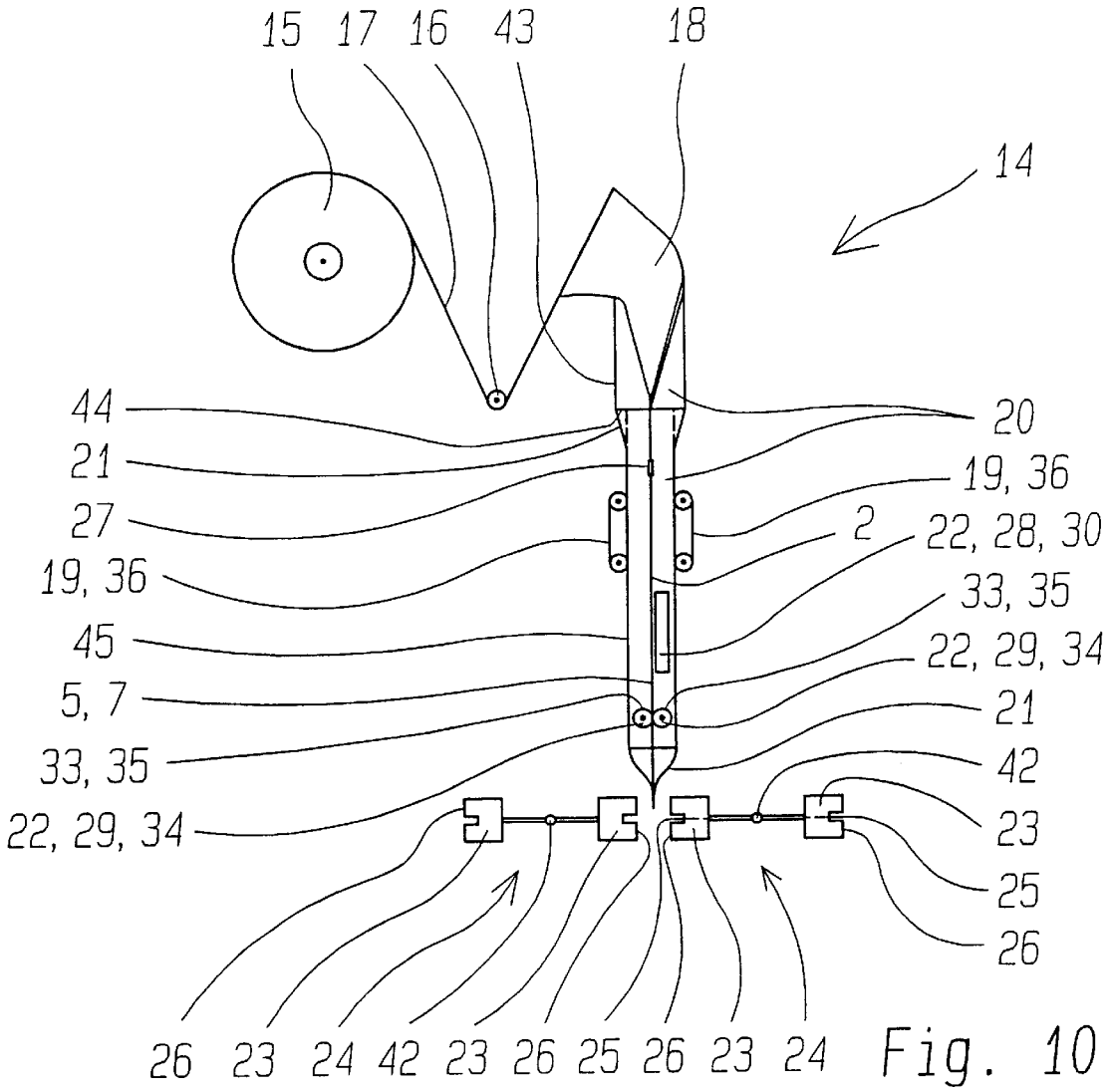
FIG. 10 is a side plan view of the tubular bagging machine of FIG. 9, which tubular bagging machine rotates vertically (downward in FIG. 10)

The tubular bagging machine 14 is continuously operated. The film feeding means 19 is thereby also continuously operated just like the rotation of the jaws 23 about their axes 42 (FIG. 10). The heat radiating from the radiating heaters 28 is proportional to the speed of the film feeding means 19, so that the amount of heat introduced into the welding seams 7, 8 is independent from other machine performance factors.

In order to maintain approximately constant radial tension of the film tube 21, the format of the fill pipe 20 is tapered in the film feeding direction by a format 43 adjusted to the forming shoulder 18 starting with a tapering 44 to a reduced format 45, whereby the expanding elements 27 are connected to the part of the fill pipe 20 having the reduced format 45, and whereby the difference of the fill-pipe radii corresponds to the different formats 43, 45 of the radial expansion of an expanding element 27.

Figure 9:
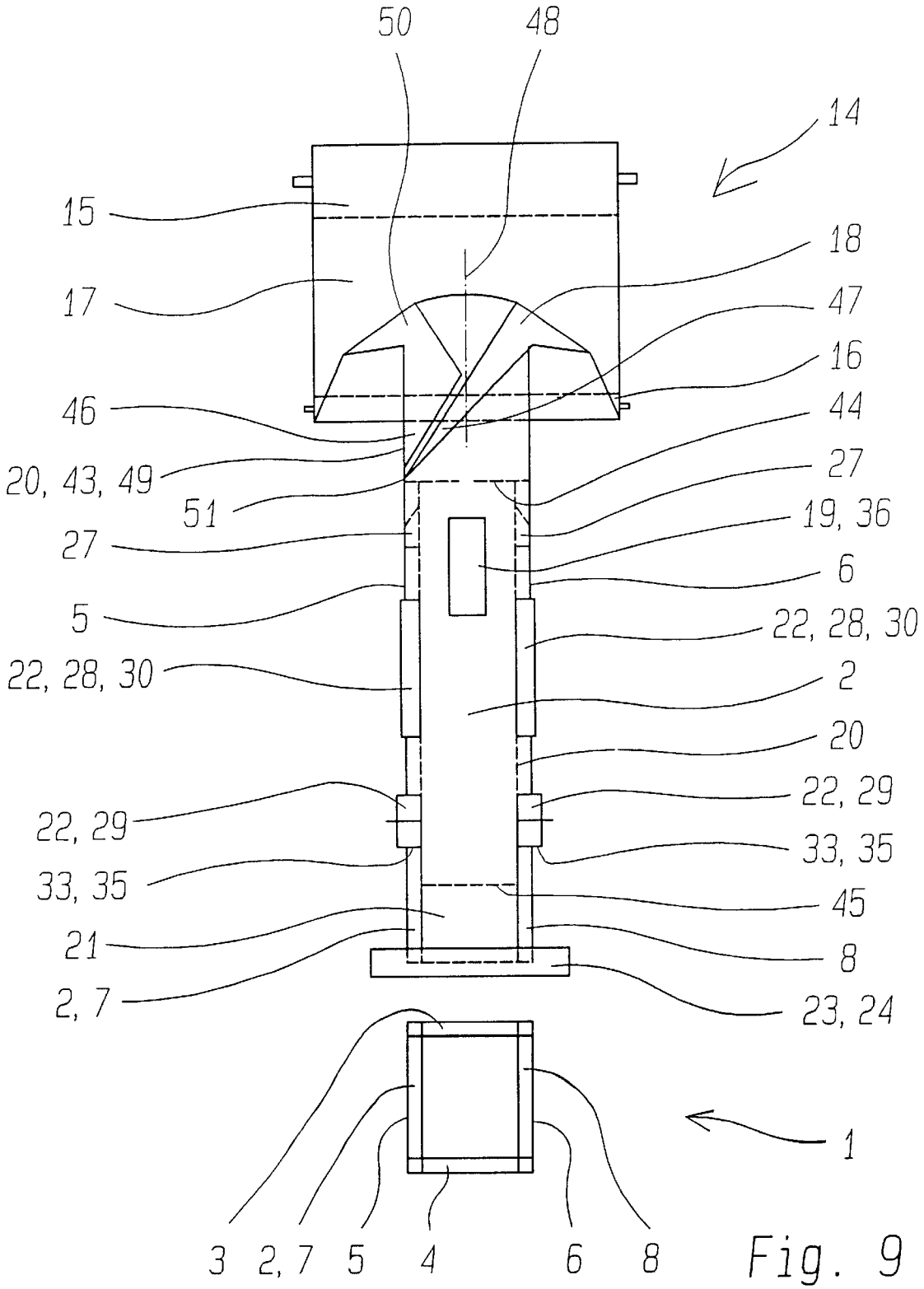
FIG. 9 is a front plan view of the principle of a tubular bagging machine for producing a tubular bag analogous to FIG. 1 with an asymmetrical forming shoulder for reshaping a flat film strip into a film tube, a tapered fill pipe, two flat expanding elements lying in a vertical plane with the sealing surfaces of closed rotating jaws of a cross-welding device, and with radiating heaters directed against the deflected tube edges and closing devices.

The asymmetrical forming shoulder 18 has two different long collar chest parts 46, 47 (FIG. 9). The longer collar chest part 47 goes beyond the centerplane of the forming shoulder 18, which centerplane goes through the longitudinal axis 48 of the shoulder sleeve 49 and the center of the collar neck part 50, namely the tip 51 of the longer collar chest part 47 has a greater radial distance from the longitudinal axis 48. With this structure, it is achieved that the film areas forming the longitudinal seam 2 lie on one another.

Figure 6:
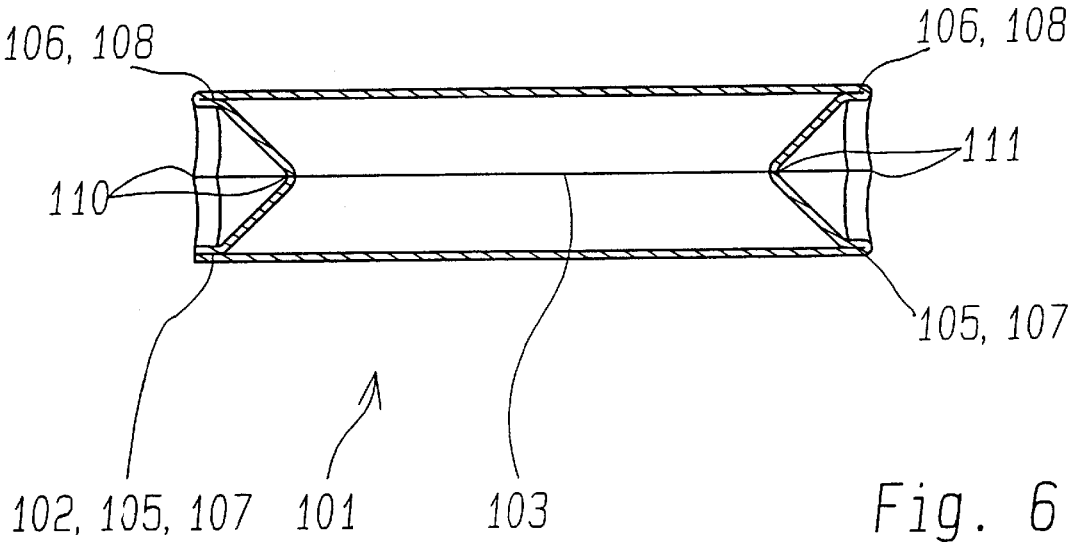
FIG. 6 is a cross-sectional view along the line VI—VI of the tubular bag of FIG. 5.

A tubular bag 101 with side folds 110, 111 has a longitudinal seam 102 and cross seams 103, 104 extending parallel to one another for closing the tubular bag 101 at the top and at the bottom (FIGS. 5, 6). Welding seams 107, 108 are provided on both of each edges 105, 106 of a side fold 110, 111 of the tubular bag 101, which edges extend parallel with respect to the longitudinal seam 102, which welding seams lend additional stiffness to the tubular bag 101 set up on the bottom-side cross seam 104 to prevent same from folding. The longitudinal seam 102 extends centrally between the edges 105 or 106 of the tubular bag 101.

The longitudinal seam 102 extends, in another exemplary embodiment (FIG. 7), in an edge-side welding seam 107. The inner surfaces of the film are here welded together along the edge 105. This tubular bag 101, which has a base 109 and is manufactured on a vertical tubular bagging machine, needs a minimum amount of film. Two welding seams 107, 108 each are provided on both side folds 110, 111. The width of a welding seam 107, 108 corresponds with a fraction of the width of a side fold 110, 111. For the purpose of a further reinforcement it would be possible to weld additionally a film strip of a weldable plastic into the welding seams 107, 108.

The embodiments of the invention in which an exclusive property or privilege is claimed are defined as follows:

1. In a tubular bagging machine including a storage roller and guide rollers for feeding a flat film band to an asymmetrical forming shoulder in a film feeding direction, collar chest parts of the forming shoulder having different lengths and including a longer collar chest part that extends beyond a centerplane of the forming shoulder, a shoulder sleeve that has a longitudinal axis, and a collar neck part, the forming shoulder extending around a centerplane, the centerplane extending through the longitudinal axis of the shoulder sleeve and a center of the collar neck part, film feeding means for moving the film band, a fill pipe for receiving the film band reshaped into a film tube, a longitudinal welding device for creating a longitudinal seam on the film tube, a cross welding device having laws for producing cross seams, and the improvement comprising a separating device for separating the film tube, the separating device having at least one flat expanding element aligned parallel with respect to the jaws and connected to the fill pipe, the at least one flat expanding element extending radially outward from said fill pipe, the at least one expanding element being in a plane with the sealing surfaces of the jaws of the cross welding device when the jaws are closed, the at least one expanding element deflecting an edge of the film tube, and the longitudinal welding device being provided after the at least one expanding element in the film feeding direction, said longitudinal welding device being directed against the deflected film tube edge.

2. The tubular bagging machine according to claim 1, wherein the fill pipe is elongate and has two ends, and wherein the at least one expanding element is directly connected to an outer surface of the fill pipe intermediate the two ends of the fill pipe.

3. The tubular bagging machine according to claim 2, wherein the longitudinal welding device contains a radiating heater and a closing device, the closing device being a roller.

4. The tubular bagging machine according to claim 2, wherein the radiating heater is arranged at an acute angle with respect to the surface of the fill pipe, and wherein the distance between the radiating heater and the fill pipe is reduced in the film feeding direction.

5. The tubular bagging machine according to claim 3, wherein the radiating heater is a longitudinal sealing jaw aligned in the film feeding direction.

6. The tubular bagging machine according to claim 3, wherein the radiating heater is a straight infrared radiating coil aligned in the film feeding direction.

7. The tubular bagging machine according to claim 6, wherein the infrared radiating coil is surrounded on three sides by an arched mirror reflecting toward the film tube.

8. The tubular bagging machine according to claim 3, wherein the closing device is a pair of oppositely directed rollers, outer surfaces of the rollers clamping the longitudinal seam therebetween.

9. The tubular bagging machine according to claim 8, wherein the rollers are driven at a speed corresponding to the unwinding speed of the film feeding means.

10. The tubular bagging machine according to claim 8, wherein the outer surfaces of the rollers have a layer containing polytetrafluoroethylene.

11. The tubular bagging machine according to claim 2, wherein the at least one expanding element includes two expanding elements extending in opposite directions away from the fill pipe, and a radiating heater and a closing device are arranged after each expanding element in the film feeding direction.

12. The tubular bagging machine according to claim 2, wherein the film feeding means has two oppositely running unwinding belts offset by 90 degrees with respect to the at least one expanding element on the fill pipe.

13. The tubular bagging machine according to claim 2, wherein the at least one expanding element is designed as a double-expanding element including two expanding elements, a side-fold producer is provided between the two expanding elements of the double-expanding element.

14. The tubular bagging machine according to claim 13, further comprising a cooling plate inserted into a side fold of the film tube, the welding device acts against the cooling plate.

15. The tubular bagging machine according to claim 14, wherein the cooling plate has an outer layer containing a polytetrafluoroethylene.

16. The tubular bagging machine according to claim 14, wherein the cooling plate is the side-fold producer.

17. The tubular bagging machine according to claim 13, further comprising a side-fold producer preceding the double-expanding element in the film feeding direction.

18. The tubular bagging machine according to claim 13, wherein an initial format of the forming shoulder is larger than a reduced-size format of the fill pipe, a tapering format is adjusted to cooperate with the forming shoulder to join the initial format to the reduced-size format, wherein the double-expanding element is connected to the reduced-sized format, and wherein the difference of radii of the initial format and the reduced-size format corresponds approximately to two thirds of the radial length of the double-expanding element.

19. The tubular bagging machine according to claim 2, wherein the film feeding means has means for continuously driving the film band.

20. The tubular bagging machine according to claim 2, wherein the forming shoulder has an initial format, the fill pipe has a reduced-sized format relative to the initial format, a tapering form joins the forming shoulder to the fill pipe, wherein the at least one expanding element is connected to the reduced-sized format of the fill tube, and wherein a radial difference between the initial format and the reduced-size format corresponds approximately to half the radial expansion of the at least one expanding element.

21. The tubular bagging machine according to claim 2, wherein the longitudinal welding device includes a heat-sealing band rotating around two rollers.

22. The tubular bagging machine according to claim 13, wherein an initial format of the forming shoulder is larger than a reduced-size format of the fill pipe, a tapering format is adjusted to cooperate with the forming shoulder to join the initial format to the reduced-size format, wherein the double-expanding element is connected to the reduced-sized format, and wherein the difference of radii of the initial format and the reduced-size format corresponds approximately to 1.5 times the radial length of one of the two double-expanding elements.

* * * * *

UNITED STATES PATENT AND TRADEMARK OFFICE

CERTIFICATE OF CORRECTION

PATENT NO. : 5 862 652

DATED : January 26, 1999

INVENTOR(S) : Wolfgang SCHOELER

It is certified that error appears in the above-indentified patent and that said Letters Patent is hereby corrected as shown below:

Column 8, line 41; change "laws" to ---jaws---.

line 63; change "2" to ---3---.

Column 9, line 20; change "2" to ---3---.

Signed and Sealed this

Ninth Day of November, 1999

*Attest:*

Q. TODD DICKINSON

*Attesting Officer*

*Acting Commissioner of Patents and Trademarks*